US010802448B2

(12) United States Patent
Sawada

(10) Patent No.: US 10,802,448 B2
(45) Date of Patent: Oct. 13, 2020

(54) ELECTRONIC TIMEPIECE

(71) Applicant: Seiko Epson Corporation, Tokyo (JP)

(72) Inventor: Akihiro Sawada, Matsumoto (JP)

(73) Assignee: Seiko Epson Corporation (JP)

( * ) Notice: Subject to any disclaimer, the term of this patent is extended or adjusted under 35 U.S.C. 154(b) by 305 days.

(21) Appl. No.: 15/923,394

(22) Filed: Mar. 16, 2018

(65) Prior Publication Data

US 2018/0275619 A1 Sep. 27, 2018

(30) Foreign Application Priority Data

Mar. 21, 2017 (JP) ..... 2017-055078

(51) Int. Cl.

| | |
|---|---|
| ***G04G 17/04*** | (2006.01) |
| ***G04R 60/12*** | (2013.01) |
| ***G04G 19/00*** | (2006.01) |
| ***G04G 17/08*** | (2006.01) |
| *G04R 20/02* | (2013.01) |

(52) U.S. Cl.

CPC ..... *G04G 17/04* (2013.01); *G04G 17/08* (2013.01); *G04G 19/00* (2013.01); *G04R 60/12* (2013.01); *G04R 20/02* (2013.01)

(58) Field of Classification Search

CPC ..... G04G 17/04; G04G 19/00; G04G 17/08; G04R 60/12; G04R 20/02

See application file for complete search history.

(56) References Cited

U.S. PATENT DOCUMENTS

| | | | | |
|---|---|---|---|---|
| 9,523,963 | B2 * | 12/2016 | Fujisawa | G04G 17/04 |
| 9,766,597 | B2 * | 9/2017 | Fujisawa | G04G 17/04 |
| 2011/0051561 | A1 * | 3/2011 | Fujisawa | G04G 5/002 368/47 |
| 2015/0268639 | A1 | 9/2015 | Abe et al. | |
| 2015/0277389 | A1 | 10/2015 | Saito et al. | |
| 2016/0161920 | A1 * | 6/2016 | Fujisawa | G04G 17/04 368/80 |
| 2016/0259304 | A1 * | 9/2016 | Fujisawa | G04R 20/02 |
| 2017/0038742 | A1 * | 2/2017 | Honda | G04R 20/02 |
| 2017/0038743 | A1 * | 2/2017 | Sawada | G04B 19/30 |

(Continued)

FOREIGN PATENT DOCUMENTS

| | | | |
|---|---|---|---|
| JP | 2012-211895 | A | 11/2012 |
| JP | 2013-040794 | A | 2/2013 |

(Continued)

*Primary Examiner* — Sean Kayes

(74) *Attorney, Agent, or Firm* — Harness, Dickey & Pierce, P.L.C.

(57) ABSTRACT

Provided is technology that suppresses increasing the thickness of the electronic timepiece when a member is provided to obscure the area where the solar battery is not located above the antenna. An electronic timepiece has: an optically transmissive dial; a solar battery having a photovoltaic solar cell; an antenna disposed relative to the dial in the direction in which the external light is emitted, and configured to receive radio signals; and a cover member having a first part disposed between the dial and the antenna. In plan view, the antenna has a part that does not overlap the solar cell; the first part has a part that does overlaps the part of the antenna that does not overlap the solar cell; and in section view perpendicular, has an overlap between the first part and the solar battery.

13 Claims, 12 Drawing Sheets

(56) References Cited

U.S. PATENT DOCUMENTS

| | | | | |
|---|---|---|---|---|
| 2017/0060099 | A1* | 3/2017 | Fujisawa | G04G 17/04 |
| 2017/0343964 | A1* | 11/2017 | Fujisawa | G04G 17/04 |

FOREIGN PATENT DOCUMENTS

| | | | |
|---|---|---|---|
| JP | 2014-059321 | A | 4/2014 |
| JP | 2015-175805 | A | 10/2015 |
| JP | 6003937 | B2 | 10/2016 |

* cited by examiner

ELECTRONIC TIMEPIECE

BACKGROUND

1. Technical Field

The present invention relates to an electronic timepiece.

2. Related Art

Electronic timepieces having a patch antenna or other type of antenna for receiving signals such as radio signals transmitted from satellites, and a solar battery, are known from the literature. Such electronic timepieces commonly have a transparent dial so that light can pass through the dial and be incident to the solar battery. The solar battery is located on the back cover side of the dial, and the antenna is located on the back cover side of the solar battery.

To prevent a drop in reception sensitivity due to the solar battery being located above the antenna, the technology described in JP-A-2012-211895 provides a notch in the solar battery in the area above the solar battery. To prevent the notch from being visible through the transparent dial, a cover sheet is also provided between the solar battery and dial.

The technology described in JP-A-2012-211895 disposes the member used to obscure the part where the solar battery is not disposed above the antenna is superimposed over the solar battery in the thickness direction of the timepiece. This increases the thickness of the electronic timepiece.

SUMMARY

The present invention is directed to this problem, and an objective of the invention is to provide technology that suppresses increasing the thickness of the electronic timepiece when a member is provided to conceal the area where the solar battery is not located above the antenna.

To achieve the foregoing objective, an electronic timepiece according to the invention includes: an optically transmissive dial having one surface to which external light is incident, and another surface from which the external light is emitted; a solar battery disposed relative to the dial in the direction in which the external light is emitted, and having a photovoltaic solar cell; an antenna disposed relative to the dial in the direction in which the external light is emitted, and configured to receive radio signals; and a cover member having a first part disposed between the dial and the antenna; the antenna having a part that does not overlap the solar cell in plan view from the thickness direction, which is perpendicular to the face of the dial; and the first part having an overlap with the antenna in plan view, and in section view perpendicular to the thickness direction, having an overlap between the area where the first part is disposed in the thickness direction, and the area where the solar battery is disposed in the thickness direction.

Thus comprised, the first part, by being disposed overlapping the part where the solar battery is not disposed above the antenna, can obscure the part where the solar battery is not disposed above the antenna. By having an overlap in section view between the area where the first part is disposed in the thickness direction, and the area where the solar battery is disposed in the thickness direction, a member that obscures the part where the solar battery is not disposed above the antenna need not be disposed superimposed in the thickness direction with the solar battery. Increasing the thickness of the electronic timepiece can therefore be suppressed. In addition, creating a step between the position of the first part in the thickness direction, and the position of the solar battery in the thickness direction, can be suppressed. Said area can therefore be further obscured.

In an electronic timepiece according to another aspect of the invention, the cover member preferable has a second part that overlaps the solar battery in plan view.

Thus comprised, formation of a gap between the cover member and the solar battery in plan view can be suppressed.

In an electronic timepiece according to another aspect of the invention, the cover member includes a first support member configured to hold the dial; and the first support member includes at least part of the first part.

Thus comprised, the first support member is used as the cover member. Increasing the parts count by providing a separate cover member can therefore be suppressed.

In an electronic timepiece according to another aspect of the invention, the first support member has a first cantilevered part housed inside an outside case, and extending in plan view to the inside of the outside case; and the first cantilevered part includes at least part of the first part.

Thus comprised, the first support member that supports the dial can be used as the cover member by disposing to the first support member a first cantilevered part including at least part of the first part.

Further preferably in an electronic timepiece according to another aspect of the invention, the cover member includes a second support member configured to support a date indicator; and the second support member includes at least part of the first part.

Thus comprised, the second support member is also used as a cover member. Increasing the parts count by providing a separate cover member can therefore be suppressed.

Further preferably in an electronic timepiece according to another aspect of the invention, the second support member has a second cantilevered part housed inside an outside case, and extending in plan view to the outside case; and the second cantilevered part includes at least part of the first part.

Thus comprised, the second support member that supports the date indicator can be used as the cover member by disposing to the second support member a second cantilevered part including at least part of the first part.

Further preferably in an electronic timepiece according to another aspect of the invention, the second support member has a third part overlapping the solar battery in plan view, and a fourth part not overlapping the solar battery and overlapping the antenna in plan view; and the fourth part extends, relative to the third part, in the thickness direction in the direction of the solar battery, and includes at least part of the first part.

Thus comprised, the second support member that supports the date indicator can be used as the cover member by disposing to the second support member a fourth part including at least part of the first part.

Further preferably in an electronic timepiece according to another aspect of the invention, the first part has multiple parts of different thickness.

Thus comprised, by the first part having multiple parts of different thicknesses, the first part can improve filling the space between the antenna and dial.

An electronic timepiece according to another aspect of the invention preferably also has: a first support member that supports the dial; and a second support member that supports a date indicator; the cover member being embodied by members other than the first support member and second support member.

Thus comprised, a cover member can be provided without changing the structure of the first support member and second support member.

Preferable in an electronic timepiece according to another aspect of the invention, the cover member is a plastic film and has a second part that overlaps the solar battery in plan view; and the second part is formed by deforming the film in the thickness direction.

This configuration enables easily deforming the cover member, and forming the second part, using the plasticity of the plastic film.

In an electronic timepiece according to another aspect of the invention, the cover member preferably includes a second part that overlaps the solar battery in plan view, the first member including the first part, and the second member including the second part, overlapping.

Thus comprised, a cover member having the first part and the second part can be easily manufactured by a simple construction layering a first member with a second member.

In an electronic timepiece according to another aspect of the invention, the cover member is bonded to the solar battery through the second part.

This configuration enables easily assembling the electronic timepiece because the cover member and solar battery are formed as a single part.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. Note that the scale and size of members and parts shown in the figures referenced below may differ from the actual scale and size for convenience of description and illustration. The following embodiments include various technically desirable limitations while describing preferred embodiments of the invention, but the scope of the invention is not limited to the following unless such limitation is expressly stated.

Embodiment 1

A first embodiment of the invention is described below with reference to FIG. 1 to FIG. 12.

A: Summary of an Electronic Timepiece

Figure 1:
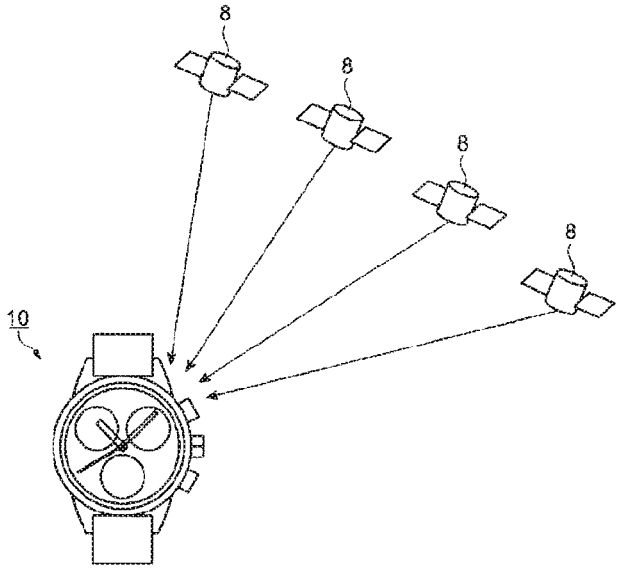
FIG. 1 illustrates a GPS system including an electronic timepiece according to the invention.

FIG. 1 is an overview of a GPS system including an electronic timepiece according to an embodiment of the invention. The outline of a GPS system whereby an electronic timepiece acquires positioning information and time information for the current location using satellite signals as external signals acquired from an external source (satellite) is described first below.

The electronic timepiece 10 in this example is a wristwatch that corrects the internal time by receiving signals (satellite signals) from GPS satellites 8, and displays the time on the opposite side (below called the face) as the side (below called the back) that is worn in contact with the skin. The GPS satellites 8 are navigation satellites orbiting the Earth on known orbits in space, and transmit a navigation message superimposed on a 1.57542 GHz carrier (L1 signal). Herein, the 1.57542 GHz signal on which the navigation message is superimposed is referred to as a satellite signal. The satellite signals are right-hand circularly polarized waves.

At present, there are approximately 30 GPS satellites 8 in orbit (only four shown in FIG. 1). To enable identifying which GPS satellite 8 transmitted a specific satellite signal, each GPS satellite 8 superimposes a unique 1023 chip (1 ms period) pattern called a C/A code (Coarse/Acquisition Code) on the satellite signals transmitted by that satellite. Each chip in the C/A code is a value of either +1 or −1 in a pseudo-random pattern. The C/A code superimposed on a particular satellite signal can therefore be detected by determining the correlation between the satellite signal and the pattern of each C/A code.

Each GPS satellite 8 carries an atomic clock, and each satellite signal carries GPS time information that is kept by the atomic clock. The electronic timepiece 10 receives the satellite signals transmitted from a single GPS satellite 8, and sets the internal time to the time (time information) acquired from the GPS time information carried in the received satellite signals.

Orbit information indicating the location of the GPS satellite 8 on its orbit is also included in the satellite signals. The electronic timepiece 10 can therefore also calculate its location (positioning information) using the GPS time information and orbit information. The positioning information calculation supposes that there is some degree of error in the internal time kept by the electronic timepiece 10. More specifically, in addition to the x, y, z parameters required to identify the location of the electronic timepiece 10 in three-dimensional space, the time error of the internal clock of the electronic timepiece 10 is also unknown. The electronic timepiece 10 therefore generally receives satellite signals transmitted from four or more GPS satellites 8, calculates the position based on the GPS time information and orbit information contained in the satellite signals, and thereby acquires positioning information identifying the current location.

Figure 2:
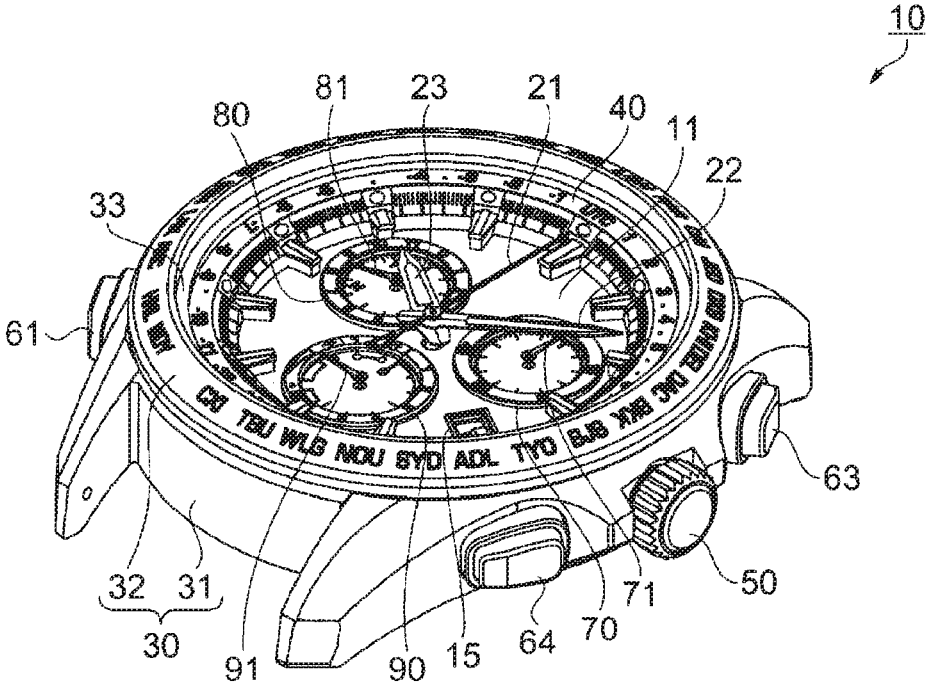
FIG. 2 is an oblique view showing an overview of an electronic timepiece.
Figure 3:
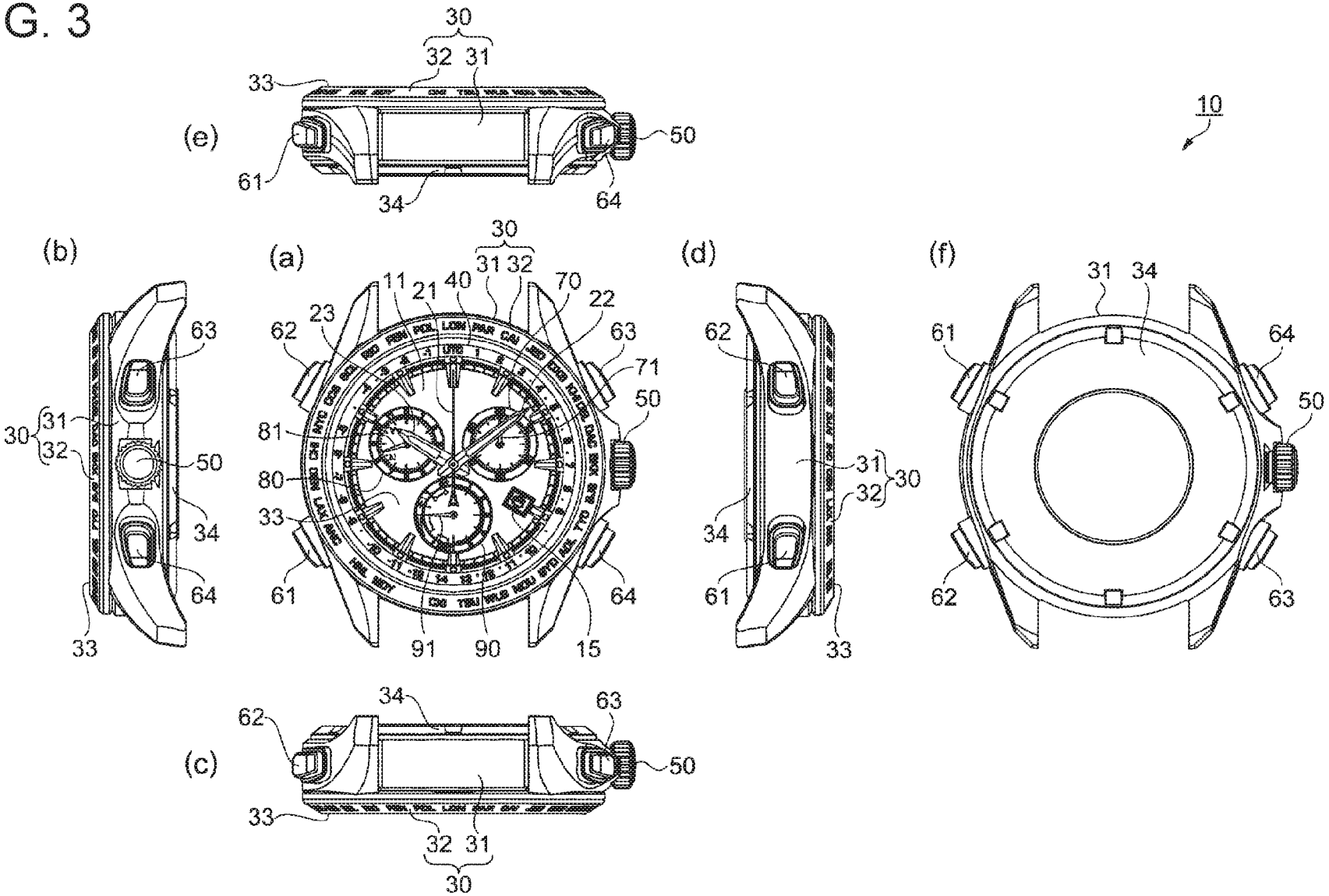
FIG. 3 shows six different views of the electronic timepiece.
Figure 4:
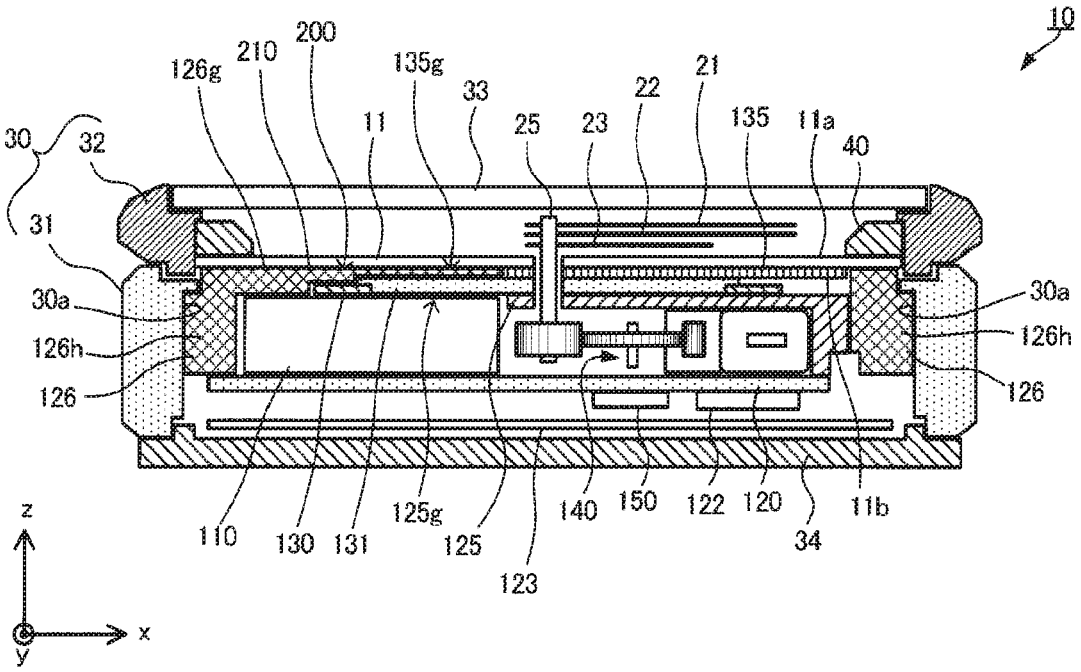
FIG. 4 is a section view showing part of the electronic timepiece.

The general configuration of the electronic timepiece 10 is described next. FIG. 2 is an oblique view of the electronic timepiece, and FIG. 3 shows six different views of the electronic timepiece. FIG. 4 is a section view showing part of the electronic timepiece.

Note that FIG. 3 (*a*) is a plan view of the electronic timepiece from the face side, and FIG. 3 (*b*) is a side view looking from the 3:00 position to the 9:00 position. FIG. 3 (*c*) is a side view looking from the 12:00 position to the 6:00 position. FIG. 3 (*d*) is a side view looking from the 9:00 position to the 3:00 position. FIG. 3 (*e*) is a side view looking from the 6:00 position to the 12:00 position. FIG. 3 (*f*) is a plan view of the back of the electronic timepiece 10.

The electronic timepiece 10 according to this embodiment has a world time function and a chronograph function.

As shown in FIG. 2 and FIG. 3, the electronic timepiece 10 has an outside case 30, a crystal 33, and a back cover 34.

The outside case 30 includes a ceramic bezel 32 fit to a tubular case member 31 made of metal. A disc-shaped dial 11 is disposed as the time display part through a plastic annular dial ring 40 on the inside circumference side of the bezel 32.

Hands 21, 22, 23 are disposed above the dial 11. Around the center of the dial 11 are further disposed a round first subdial 70 and hand 71 at 2:00; a round second subdial 80 and hand 81 at 10:00; a round third subdial 90 and hand 91 at 6:00; and a rectangular calendar window 15 at 4:00. The dial 11, hands 21, 22, 23, first subdial 70, second subdial 80, third subdial 90, and calendar window 15 can be seen through the crystal 33.

A button A 61 is disposed in the side of the outside case 30 at 8:00 from the center of the dial 11; a button B 62 is disposed at 10:00; a button C 63 is disposed at 2:00; a button D 64 is disposed at 4:00; and a crown 50 is disposed at 3:00. When button A 61, button B 62, button C 63, button D 64, or crown 50 is operated, an operating signal corresponding to the specific operation is output.

As shown in FIG. 4, of the two main openings in the metal outside case 30, the opening on the face side of the electronic timepiece 10 is covered by the crystal 33 through the intervening bezel 32, and the opening on the back side is covered by the metal back cover 34.

Disposed (housed) inside the outside case 30 are the dial ring 40 attached to the inside circumference of the bezel 32; an optically transmissive dial 11; a center pivot 25 that passes through the dial 11; the hands 21, 22, 23 that rotate on the center pivot 25; a solar battery 135; antenna 110; dial bridge ring 126; main plate 125; date indicator 130; date indicator bridge 131; and a drive mechanism 140 that drives the hands 21, 22, 23.

The center pivot 25 passes through the plane center of the outside case 30, and is aligned on the center axis through the face and back cover.

The dial ring 40 is disposed with its outside edge touching the inside circumference of the bezel 32, has a flat surface parallel to the crystal 33, and a beveled portion sloping to the dial 11 with the inside circumference edge touching the dial 11. The dial ring 40 is shaped like a ring in plan view, and is conically shaped when seen in section.

The dial 11 is a round disk for displaying the time inside the outside case 30, is made from plastic or other optically transmissive material, for example transparent material. The dial 11 is disposed below the dial ring 40 with the hands 21, 22, 23 between the dial 11 and crystal 33.

The dial 11 has a first side 11*a* to which external light is incident, and an other side 11*b* from which the external light is emitted.

The view of the parts of the electronic timepiece 10 from the direction perpendicular to the dial 11 (the direction parallel to the axis of the center pivot 25) is referred to as the plan view. The direction perpendicular to the dial 11 is also referred to as the thickness direction.

The view of the parts of the electronic timepiece 10 when seen in section from the direction parallel to the face of the dial 11 is referred to as the view in cross section.

The side on the back cover 34 side of the dial 11 is referred to as below or the back cover side in the thickness direction, and the side on dial 11 side of the back cover 34 is referred to as above or the face side in the thickness direction. An XYZ coordinate system, with the Z-axis being the thickness direction (with Z pointing to the top or face), is shown in FIG. 4.

The solar battery 135 (photovoltaic cell) is disposed on the side of the dial 11 to which the external light is emitted (that is, below the dial 11). The solar battery 135 is disposed between the dial 11 and main plate 125. The solar battery 135 comprises solar cells (photovoltaic devices) that convert light energy to electrical energy (power) when light emitted from (passing through) the dial 11 is incident thereto. The solar battery 135 also has a sunlight detection capability.

The antenna 110 for receiving radio signals is disposed on the side of the dial 11 in the direction to which external light is emitted (that is, below the dial 11). The antenna 110 is disposed below the solar battery 135. The antenna 110 in this example is a patch antenna (also called a microstrip antenna).

As described in detail below, if the solar cells of the solar battery 135 are superimposed in plan view with the antenna 110, the radio signals the antenna 110 should receive will be shielded. To suppress such shielding, a notch 135*g* is formed in the solar battery 135. The antenna 110 is disposed below the notch 135*g* with a part that is not superimposed with the solar battery 135 (at least the solar cells) in plan view.

Because the dial 11 is transmissive, the notch 135*g* in the solar battery 135 can be easily seen through the dial 11. The electronic timepiece 10 therefore has a cover 200 to conceal the notch 135*g* by covering the notch 135*g*. The cover 200 has a main cover part 210 (first part), which is the part covering the notch 135*g*.

The main cover part 210 is disposed between the dial 11 and antenna 110, has an overlap with the antenna 110, and in section view is disposed so that the area where the main cover part 210 is disposed in the thickness direction, and the area where the solar battery 135 is disposed in the thickness direction, have an overlap. The main cover part 210 may also be colored to further obscure the notch 135*g*. To suppress signal shielding as described above, the main cover part 210 is also preferably made of plastic or other material not containing metallic elements. The antenna 110 is disposed below the main cover part 210.

A dial bridge ring 126 (first support member) that supports the dial 11 is disposed in the direction in which external light is emitted from the dial 11 (that is, below the dial 11). The dial bridge ring 126 is made of plastic. The dial bridge ring 126 is disposed along the inside circumference surface 30*a* of the (of the case member 31) of the outside case 30, and has a cantilevered part 126*g* (first cantilevered part) extending in plan view to the inside of the outside case 30.

The cantilevered part 126*g* extends to cover the notch 135*g* of the solar battery 135, has an overlap with the antenna 110 in plan view, and functions as the main cover part 210 of the cover 200. Because the cantilevered part 126*g* is made of plastic, signal shielding as described above is not a problem even though the cantilevered part 126*g* is superimposed with the antenna 110. By having a cantilevered part 126*g* that functions as the main cover part 210, the dial bridge ring 126 also functions as the cover 200.

Disposed to the main plate 125 are the date indicator 130 and the date indicator bridge 131 (second support member) that supports the date indicator 130. The date indicator 130 and date indicator bridge 131 are plastic. The date indicator 130 and date indicator bridge 131 are disposed between the solar battery 135 and cantilevered part 126*g* of the dial bridge ring 126, and the main plate 125.

Through-holes through which the center pivot 25 and the pivots of the hand 71 of the first subdial 70, the hand 81 of the second subdial 80, and the hand 91 of the third subdial 90 pass are formed in the dial 11, solar battery 135, date indicator bridge 131, and main plate 125. An opening for a calendar window 15 is also formed in the dial 11 and solar battery 135.

The main plate 125 is made of plastic, and has attachments for the drive mechanism 140. Reception performance improves as the thickness of the antenna 110 increases (as the volume increases). This embodiment of the invention therefore assures antenna 110 thickness by providing a notch 125*g* in the main plate 125, and disposing the area of the antenna 110 in the thickness direction overlapping the area where the main plate 125 is disposed in the thickness direction (that is, disposing the antenna 110 to the same height (elevation) as the main plate 125).

The drive mechanism 140 is attached to the main plate 125, and is covered from the back cover side by a circuit board 120. The drive mechanism 140 includes a stepper motor and a wheel train of wheels, and the hands 21, 22, 23 are driven by the stepper motor turning the center pivot 25 through the wheel train. The small hands 81, 82 of the small dial 80 have a similar drive mechanism (not shown in the figure) that drives the small hands 81, 82. The hand 71 of the first subdial 70, the hand 81 of the second subdial 80, and the hand 91 of the third subdial 90 shown in FIG. 2 and FIG. 3 have similar drive mechanisms (not shown in the figure) that drive the hands 71, 81, 91.

Disposed to the circuit board 120 are a receiver (GPS module) 122, controller 150, and antenna 110. The circuit board 120 is also connected to a lithium ion battery or other type of storage battery (not shown in the figure) that is charged by power produced by the solar battery 135. Below the circuit board 120 is a circuit cover 123.

B: Display Functions of the Electronic Timepiece

Figure 5:
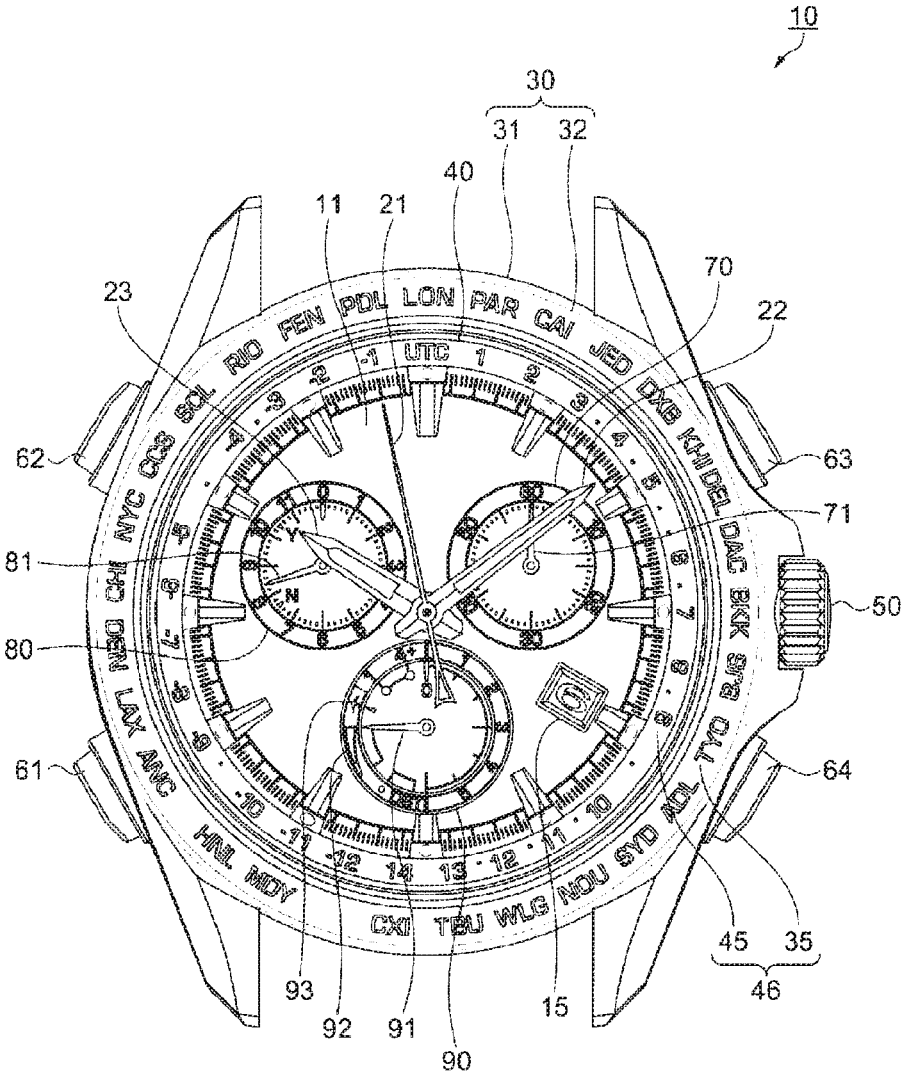
FIG. 5 is a plan view showing the appearance of the electronic timepiece.

Display functions of the electronic timepiece 10 are described next. FIG. 5 is a plan view showing the face of the electronic timepiece 10.

As shown in FIG. 5, a scale of markers dividing the outside circumference of the dial 11 into from 6 divisions to 60 divisions, and dividing each of the 60 divisions into a ⅕ scale of 5 divisions each, is formed around the outside perimeter of the dial 11. Using this scale, the second hand 21 indicates the seconds of the chronograph time, the minute hand 22 indicates the minute of the internal time, and the hour hand 23 indicates the hour of the internal time. Note that the chronograph function can be used by operating the button C 63 and button D 64.

A scale of 60 divisions with numeric markers 10 to 60 at increments of 10 is disposed around the outside of the round first subdial 70 on the dial 11. The hand 71 of this first subdial 70 uses this scale to indicate the minute of the chronograph time.

A scale of 60 divisions with numeric markers 0 to 11 is disposed around the outside of the round second subdial 80 on the dial 11. The hand 81 of this second subdial 80 uses this scale to indicate the second of the internal time.

The letter Y is disposed to the 52-second position and the letter N is disposed to the 38-second position of the second subdial 80. These letters are used to indicate the result of satellite signal reception (Y=reception successful; N=reception failed), and to indicate whether or not the automatic satellite signal reception mode is set (Y=automatic reception is ON; N=automatic reception is OFF). If the user pushes operating button B 62, the hand 81 jumps to either Y or N to indicate the result of satellite signal reception. If the user pushes button A 61 and button B 62, the hand 81 jumps to either Y or N to indicate whether automatic satellite signal reception is ON or OFF. If the user operates button B 62 to manually start satellite signal reception by the electronic timepiece 10, the hand 81 moves to indicate the number of satellites that have been locked onto.

Note that while the Y marker is at the 52-second position and the N marker is at the 38-second position in this example, the invention is not so limited. The Y and N markers are preferably disposed where they can be easily read in relation to the location of the small dial including the reception result indicators.

The information indicated using the round third subdial 90 on the dial 11 is described next. Note that below referring to the direction of n:00 (where n is a natural number) on the third subdial 90 means the position of that time on an imaginary clock dial centered on the pivot of the hand 91.

A scale of six divisions with numeric markers 0 to 5 is formed on the outside perimeter of the third subdial 90 from 12:00 to 6:00. Using this scale, the hand 91 indicates the hour of the chronograph time. Note that the chronograph function can keep time to 5 hours 59 minutes 59 seconds using hands 21, 71, and 91.

The letters DST and an open circle (O) are disposed to the third subdial 90 in the area from 6:00 to 7:00. DST denotes Daylight Saving Time. These markers are used to indicate if daylight saving time is being used (DST=the daylight savings time mode is on; O indicates the DST mode is off). The user can turn the daylight saving time mode of the electronic timepiece 10 on or off by operating the crown 50 and button B 62 to set the hand 91 to the DST or O marker.

A sickle-shaped marker 92 that is wide at the base at 9:00 and narrows to the end at 7:00 is disposed along the outside edge of the third subdial 90 from 7:00 to 9:00. This marker 92 is a power reserve indicator, and the hand 91 indicates a position at the base, middle, or distal end of the marker 92 according to the reserve power in the battery.

An airplane-shaped marker 93 is disposed in the area between 9:00 and 10:00 on the outside of the third subdial 90. This airplane marker 93 denotes an in-flight mode. Satellite signal reception is prohibited in some countries by aviation regulations during take-off and landing of an airplane. Satellite signal reception by the electronic timepiece 10 can be disabled (turned off) by the user operating button A 61 to set the hand 91 to the airplane marker 93 (in-flight mode).

Numeric markers 1 and 4+ are disposed in the area from 10:00 to 12:00 on the outside of the third subdial 90. These markers are used to indicate the satellite signal reception mode. The 1 marker means that the GPS time information is received and the internal time corrected, and the 4+ marker means that GPS time information and orbit information are received, and the internal time and time zone described below are corrected. When the user operates the button B 62, the hand 91 jumps to either the 1 or the 4+ marker to indicate the reception mode in which the electronic timepiece 10 just received satellite signals.

The calendar window 15 is a rectangular opening formed in the dial 11, and a number on the calendar wheel can be seen through the calendar window 15. This number indicates the day value of the date.

The relationship between UTC (Coordinated Universal Time), time differences, standard time, and time zones is described next.

A time zone is a region that uses the same standard time, and there are presently approximately 40 time zones around the world. Each time zone is identified by the time difference between the standard time used in that time zone and UTC. For example, Japan uses a standard time that is 9 hours ahead of UTC, and belongs in a time zone of +9 hours. The standard time used in each time zone can be determined from UTC and the time difference to UTC.

As described above, a scale of 60 minute and second markers is disposed around the dial 11, and time difference information 45 for indicating the time difference to UTC using numeric and non-numeric markers is displayed beside this scale of markers on the dial ring 40 around the outside edge of the dial 11. Numeric time difference information 45 indicates the integer number of hours of the time difference, and the non-numeric markers indicate a time difference less than one hour. The time difference between UTC and the internal time indicated by the hands 22, 23, 81 can be checked by reading the time difference information 45 indicated by the second hand 21 when the crown 50 is operated.

By assigning one time difference to each of the 60 minute markers provided on the dial 11, the electronic timepiece 10 can display an internal time kept for a maximum 60 different time differences. Note that in this example the UTC marker of the time difference information 45 indicates Coordinated Universal Time, which is the reference time for all time differences, and black bullets (●) indicate time differences of less than one hour (non-integer values), but other symbols may be used instead.

In this example, the time difference information 45 indicated by a bullet between the 8 and 9 on the dial ring 40 indicates a time difference of +8.75 hours (+8 hours 45 minutes), and indicates a time zone using a standard time of UTC+8.75 hours. There are currently approximately 40 time zones around the world. Time difference information 45 indicating the time difference in these approximately 40 time zones is disposed on the dial ring 40 of the electronic timepiece 10 in this embodiment of the invention. There are also preferably fewer than 60 time zone markers. Displaying markers for 60 or more time zones means the time zone markers will become smaller and could become difficult to read or differentiate.

On the bezel 32 disposed around the dial ring 40 are disposed city name markers 35 beside the corresponding time difference information 45 markers on the dial ring 40. The city name markers 35 indicate the name of a city representative of the time zone using the standard time corresponding to the time difference indicated by the time difference information 45 shown on the dial ring 40. In this example, the city name markers 35 use three-letter codes, which are three letter abbreviations of the city names. For example, LON denotes London, PAR denotes Paris, CAI denotes Cairo, JED denotes Jeddah, DXB denotes Dubai, KHI denotes Karachi, DEL denotes Delhi, DAC denotes Dhaka, BKK denotes Bangkok, BJS denotes Beijing, TYO denotes Tokyo, ADL denotes Adelaide, SYD denotes Sydney, NOU denotes Noumea, WLG denotes Wellington, TBU denotes Nuku'alofa, CXI denotes Christmas Island, MDY denotes Midway Island, HNL denotes Honolulu, ANC denotes Anchorage, LAX denotes Los Angeles, DEN denotes Denver, CHI denotes Chicago, NYC denotes New York, CCS denotes Caracas, SCL denotes Santiago, RIO denotes Rio de Janeiro, FEN denotes Fernando de Noronha, and PDL denotes the Azores.

In this example, the code TYO represents Tokyo, and the number 9 of the time difference information 45 displayed on the dial ring 40 beside the TYO code shows that the time difference between Tokyo and UTC is +9 hours. The code CXI represents Christmas Island, and the number 14 of the time difference information 45 displayed on the dial ring 40 beside the CXI code shows that the time difference between Christmas Island and UTC is +14 hours. Note that this example omits the city code for some of the time differences indicated by the time difference information 45.

The invention is also not limited to this method of indicating the city names, and other methods may be used. The time difference information 45 and city name markers 35 are referred to as time zone indicators 46. The electronic timepiece in this example has the same number of time zone indicators 46 as there are time zones around the world. The city name markers shown in FIG. 2 are also only examples, and the city names may be changed as appropriate to changes in time zones.

C: Electrical Configuration of the Electronic Timepiece

The electrical configuration of the electronic timepiece 10 is described next.

Figure 6:
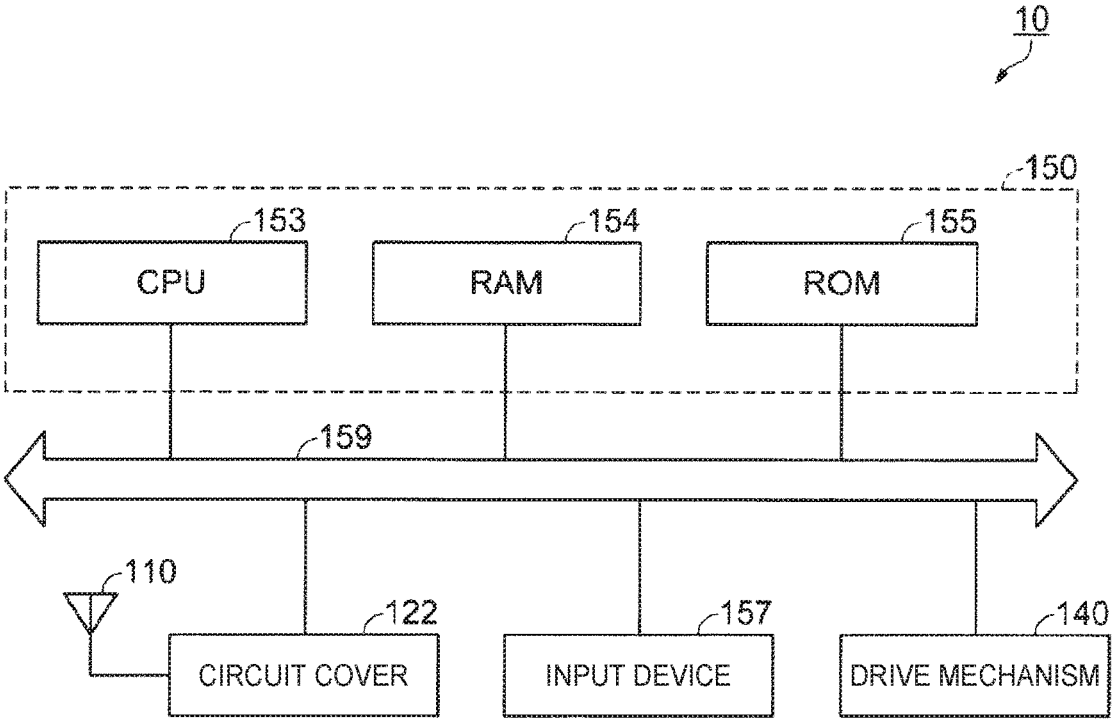
FIG. 6 is a block diagram illustrating the electrical control system of the electronic timepiece.

FIG. 6 is a block diagram of the electrical control system of the electronic timepiece. As shown in FIG. 6, the electronic timepiece 10 has a controller 150 including a CPU (Central Processing Unit) 153, RAM (Random Access Memory) 154, ROM (Read Only Memory) 155, and peripheral devices including a receiver (GPS module) 122, input device 157, and drive mechanism 140. These devices exchange data therebetween through a data bus 159. The input device 157 includes the crown 50 shown in FIG. 5, button A 61, button B 62, button C 63, and button D 64. Note that the electronic timepiece 10 also has an internal rechargeable storage battery (not shown in the figure) as the power supply.

The receiver 122 includes the antenna 110, processes satellite signals received through the antenna 110, and acquires GPS time information and positioning information. The antenna 110 receives the radio waves of the satellite signals transmitted from multiple GPS satellites 8, which are orbiting the Earth on known orbits in space (see FIG. 1), and passing through the crystal 33 shown in FIG. 4.

While not shown in the figure, the receiver 122, similarly to a conventional GPS receiver, also includes an RF (radio frequency) unit for receiving and converting the satellite signals transmitted from the GPS satellites 8 (see FIG. 1) to digital signals; a baseband unit for applying a correlation process to the received signals and demodulating the navigation message; and an information acquisition unit for acquiring and outputting the GPS time information and positioning information (location information) from the navigation message (satellite signals) demodulated by the baseband unit. In other words, the receiver 122 functions as a reception module that receives satellite signals transmitted from the GPS satellites 8, and based on the received signals outputs GPS time information and positioning information.

The RF unit includes a bandpass filter, PLL circuit, IF filter, VCO (Voltage Controlled Oscillator), ADC (Analog/Digital Converter), mixer, LNA (Low Noise Amplifier), and IF amplifier. The satellite signals are extracted by the bandpass filter, then amplified by the LNA, mixed by the mixer with the VCO signal, and then down-converted to an IF (Intermediate Frequency) signal. The IF signal mixed by the mixer passes through the IF amplifier and IF filter, and is converted to a digital signal by the ADC.

The baseband unit also has a local code generator that generates a local code of the same C/A codes used by the transmitting GPS satellites 8, and a correlator that calculates the correlation between the local code and the received signal output from the RF unit. If the correlation calculated by the correlator equals or exceeds a specific threshold, the C/A code used in the received satellite signal is determined to match the local code that was generated, and the receiver 122 can lock onto (synchronize with) the satellite signal. The navigation message can be demodulated by this process of correlating the received satellite signal with a local code.

The information acquisition unit acquires the GPS time information and positioning information from the navigation message demodulated by the baseband unit. The navigation message includes preamble data, a HOW word with TOW (Time of Week, also referred to as the Z count) information, and subframe data. The subframe data includes subframe 1 to subframe 5, and each subframe carries satellite correction data including week number data and satellite health data, and orbit information including ephemeris (detailed orbit information for a particular GPS satellite 8) and an almanac (coarse orbit information about all GPS satellites 8). The information acquisition unit can therefore acquire the GPS time information and positioning information by extracting specific data portions from the received navigation message.

RAM 154 and ROM 155 embody the memory of the electronic timepiece 10.

A program executed by the CPU 153, and other information such as time zone information, is stored in ROM 155. The time zone information is data for managing positioning information (latitude and longitude) about the region (time zone) using a common standard time, and the time difference of that region to UTC.

The CPU 153, by running the program stored in ROM 155 using RAM 154 as working memory, performs various calculation, control, and timekeeping processes. In this example, time is kept by counting the number of pulses in a reference signal output from a crystal oscillator not shown.

The CPU 153 corrects the time kept internally (the internal time) based on time information calculated from the GPS time information and time correction parameter, the positioning information (latitude and longitude) for the current location calculated from the GPS time information and orbit information, and time zone information stored in ROM 155 (memory). The CPU 153 also controls driving the drive mechanism 140 to display the internal time. As a result, the internal time is displayed on the electronic timepiece 10 by the hands 22, 23, 81 (FIG. 5).

D: Cover Configuration

The configuration of the cover 200 of the electronic timepiece 10 is described next.

Figure 7:
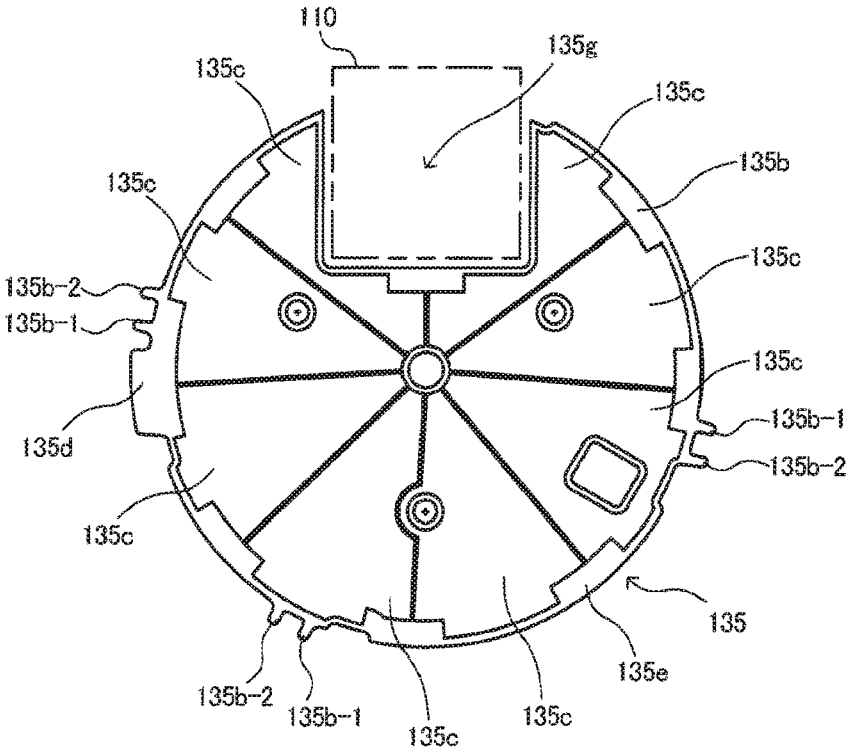
FIG. 7 is a plan view of the solar battery.

The locations of the solar battery 135 and antenna 110 in plan view are described first. FIG. 7 is a plan view showing the shape of the solar battery 135. The outline of the antenna 110 is also shown in FIG. 7. In this example, the antenna 110 is rectangular in plan view, and is located at 12:00.

The solar battery 135 has a solar film 135*b*. In addition to the solar film 135*b*, the solar battery 135 may have a guide plate to which are disposed positioning parts for attaching the solar battery 135 to other members (such as the main plate 125 or the dial bridge ring 126).

The solar film 135*b* includes a substrate 135*e* and solar cells 135*c*. The substrate 135*e* is made from a plastic film, for example, and the solar cells 135*c* are formed on the substrate 135*e*. The solar cells 135*c* have a semiconductor part and an electrode part. The semiconductor part converts light energy to electrical energy by photovoltaic conversion. The electrode part has electrodes on opposite sides of the semiconductor part. An optically transparent electrode may be used as the electrode on the side to which light is incident.

The outside of the solar battery 135 a substantially a circle. The multiple (in this example, eight) solar cells 135*c* are arrayed along the circumference of the circle and are connected in series. The solar battery 135 has a rectangular notch 135*g* at the 12:00 position so that it has a part where the antenna 110 can be disposed without having an overlap with the solar battery 135 (without having an overlap with at least a solar cell 135*c*) in plan view. The notch 135*g* is formed in both the substrate 135*e* and solar cells 135*c*.

If the electrode part of the solar cells 135*c* is superimposed in plan view with the antenna 110, the radio waves of the satellite signals the antenna 110 should receive will be shielded. Because the antenna 110 has a part that is not superimposed with the notch 135*g* in plan view, this shielding effect can be suppressed.

Note that this example describes a configuration in which a notch 135*g* is formed in the outside circumference part of the solar battery 135 to provide a part where the antenna 110 does not overlap the solar cells 135*c* in plan view. Alternatively, a part where the antenna 110 does not overlap the solar cells 135*c* in plan view may be provided by forming an opening (through-hole) at a different location inside the solar battery 135 in plan view.

Note that all parts of the antenna 110 preferably have no part superimposed in plan view with the solar cells 135*c*, but even if part of the antenna 110 is superimposed with the solar cells 135*c*, the shielding described above can still be suppressed compared with when all parts of the antenna 110 are superimposed with the solar cells 135*c*.

Disposed on the outside circumference part of the substrate 135*e* are guide tabs 135*b*-1 and guide tabs 135*b*-2, and a conductor 135*d*. The guide tabs 135*b*-1 and guide tabs 135*b*-2 are used as positioning parts for positioning the solar battery 135 on the main plate 125. The conductor 135*d* is used to dispose a conductive spring for electrically connecting the solar battery 135 to the circuit board 120.

Figure 8:
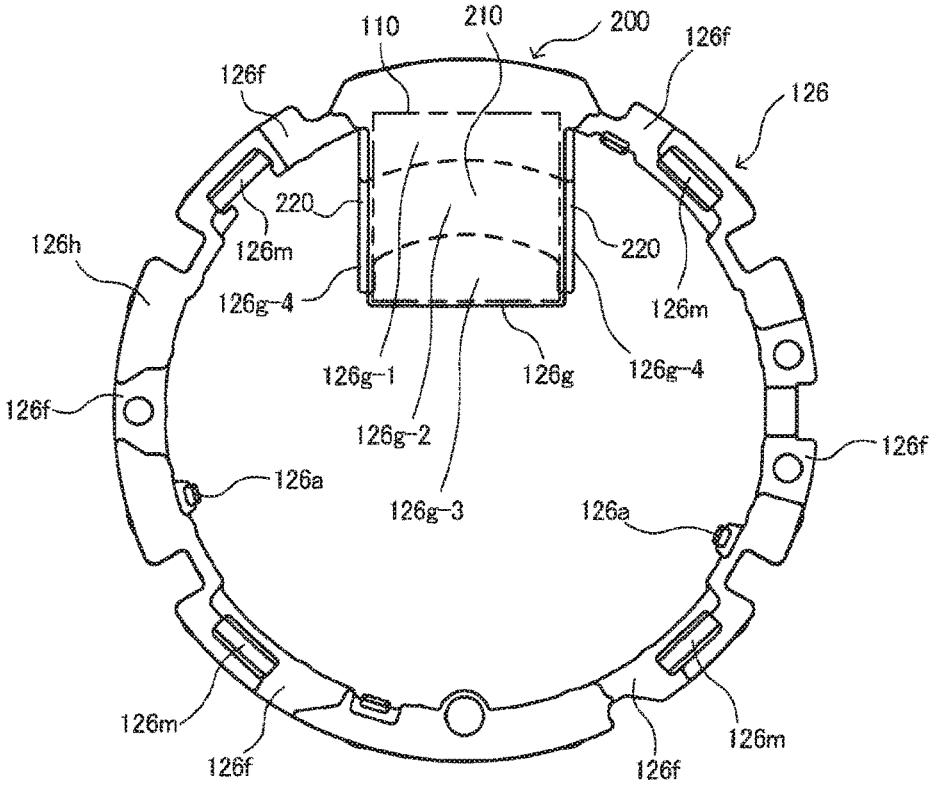
FIG. 8 is a plan view of the dial bridge ring.

The placement of the dial bridge ring 126 and antenna 110 in plan view is described next. FIG. 8 is a plan view showing the appearance of the dial bridge ring 126. The outline of the antenna 110 is also shown in FIG. 8.

The dial bridge ring 126 has a ring part 126*h*, which is shaped like a ring conforming to the inside circumference surface 30*a* of the outside case 30, and a cantilevered part 126*g* that protrudes from the ring part 126*h* toward the inside surface of the outside case 30.

The cantilevered part 126*g* is rectangular and disposed at 12:00 to have a part that overlaps the antenna 110 in plan view. The cantilevered part 126*g* functions as the main cover part 210 of the cover 200 as described above. The cantilevered part 126*g* is described in further detail below.

The ring part 126*h* has a solar battery hooks 126*a*, a main plate bridge 126*f*, and protrusions 126*m*. The solar battery hooks 126*a* are used to secure the solar battery 135 to the dial bridge ring 126. Engaging parts (not shown in the figure) disposed to the guide plate described above are engaged by the hooks 126*a*. The main plate bridge 126*f* is disposed to a position corresponding to flanges 125*f* of the main plate 125, and the flanges 125*f* are fit to the main plate bridge 126*f*. The protrusions 126*m* project toward the back cover 34 from the bottom of the dial bridge ring 126, and by contacting the back cover 34 when the dial bridge ring 126 is housed in the outside case 30, limits movement of the dial bridge ring 126 in the thickness direction.

Figure 9:
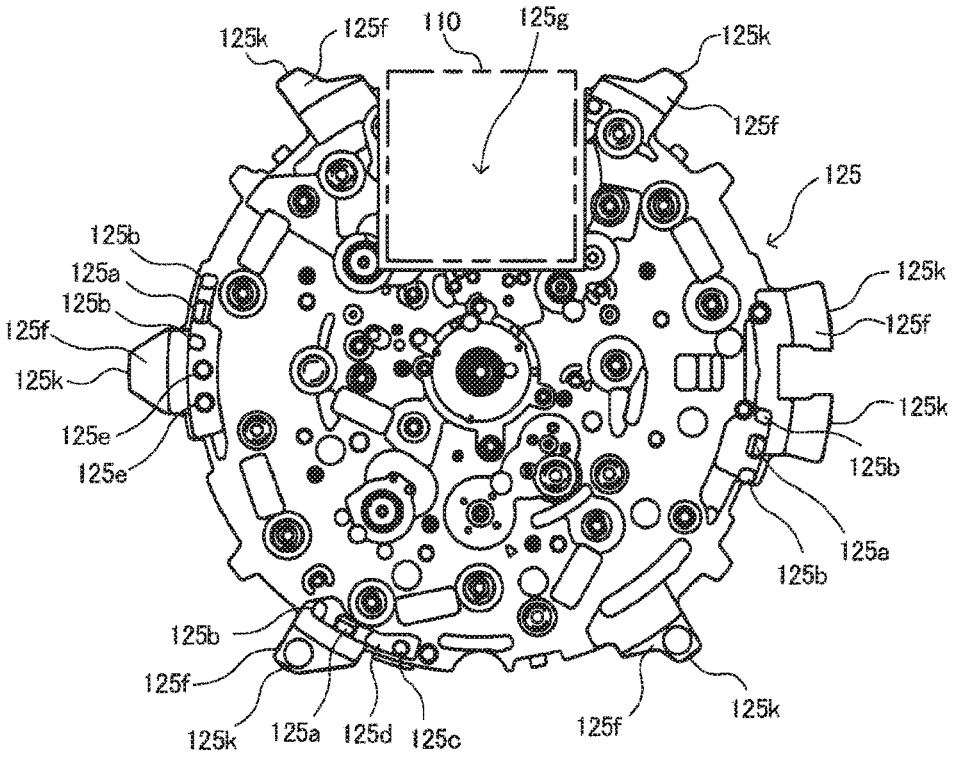
FIG. 9 is a plan view of the main plate.

The disposition of the main plate 125 and antenna 110 in plan view is described next. FIG. 9 is a plan view of the main plate 125. The outline of the antenna 110 is also shown in FIG. 9.

As described above, the main plate 125 has a rectangular notch 125*g* at 12:00 so that the antenna 110 can be disposed to the same height as the main plate 125 while assuring sufficient antenna 110 thickness.

Note that providing a notch 125*g* in the main plate 125 is not necessary if antenna 110 thickness required to achieve sufficient reception performance can be assured without disposing the antenna 110 to the same elevation as the main plate 125. The main plate 125 may also be made of metal as required. If the main plate 125 is metal, the shielding effect described above can be suppressed by providing a notch 125*g*. The notch 125*g* in this example is disposed so that all of the antenna 110 is not superimposed with the main plate 125 in plan view, but the main plate 125, as may be necessary, may be disposed with part of the antenna 110 superimposed with the main plate 125 in plan view.

Disposed to the main plate 125 are guide protrusions 125*a*, dial height positioning pedestals 125*b*, fastening pin 125*c*, and a flange 125*d* to which the fastening pin 125*c* is disposed.

The solar battery 135 is positioned to the main plate 125, and movement in the circumferential direction is restricted, by the guide tabs 135*b*-1 and guide tabs 135*b*-2 of the solar battery 135 being set with the guide protrusions 125*a* therebetween. The dial height positioning pedestals 125*b* and flange 125*d* embody a dial mounting surface on which the dial 11 rests. The fastening pin 125*c* fits into a hole in the dial ring 40, and secures the dial ring 40.

Also disposed to the main plate 125 are through-holes 125*e*, flanges 125*f*, and tabs 125*k* disposed to the distal ends of the flanges 125*f*. A conductive spring for electrically connecting the solar battery 135 and the circuit board 120 is disposed in the through-holes 125*e*. The main plate 125 and dial bridge ring 126 are mutually engaged by the flanges 125*f* being fit to the main plate bridge parts 126*f* of the dial bridge ring 126. The tabs 125*k* restrict movement of the main plate 125 in the plane direction by contacting the inside circumference side of the case member 31 when the main plate 125 is set in the outside case 30.

The relative positions in plan view, and the relative positions in section view, of the solar battery 135, GPS reception unit 26, date indicator 130, date indicator bridge 131, and antenna 110 are described next, in conjunction with description of the cantilevered part 126*g* that functions as the cover 200 and main cover part 210.

The direction passing through the center pivot 25 in plan view is defined herein as the radial direction. With respect to the radial direction, the side towards the center pivot 25 is the inside circumference side, and the opposite side as the inside circumference side is the outside circumference side.

Figure 10:
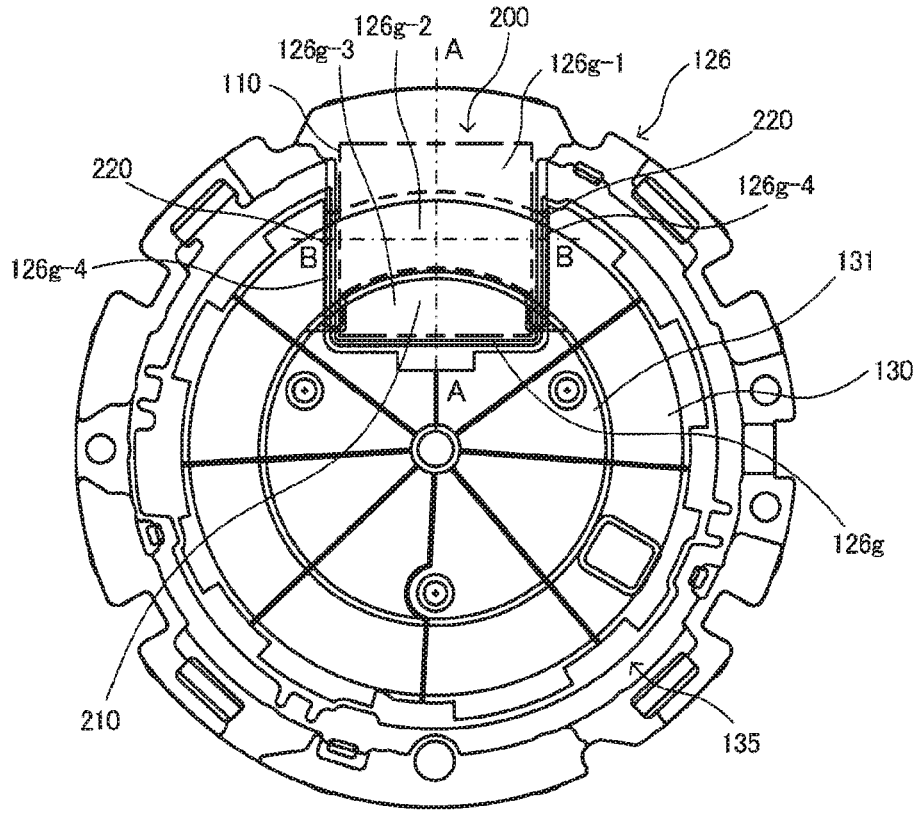
FIG. 10 illustrates superimposition of the solar battery and dial bridge ring.

FIG. 10 is a plan view of the solar battery 135 and dial bridge ring 126 mutually superimposed in plan view. The outlines of the date indicator 130, date indicator bridge 131, and antenna 110 are also shown in FIG. 10.

Figure 11:
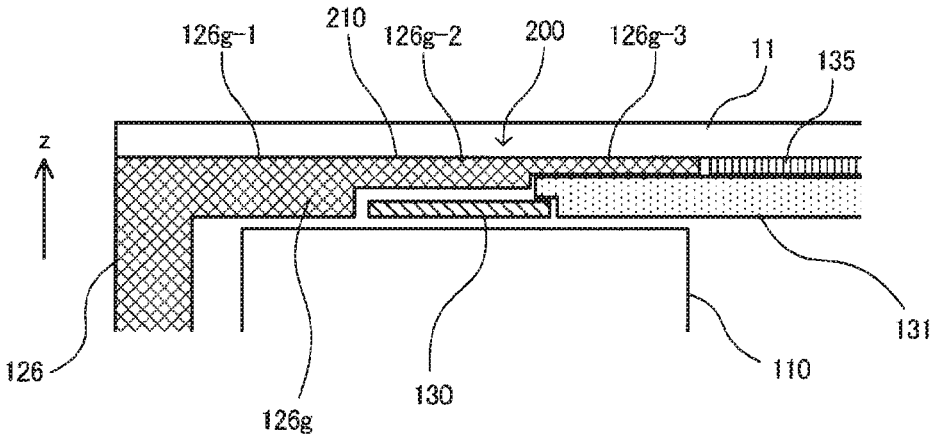
FIG. 11 is a partial section view of the electronic timepiece according to the first embodiment of the invention in the radial direction through the antenna.
Figure 12:
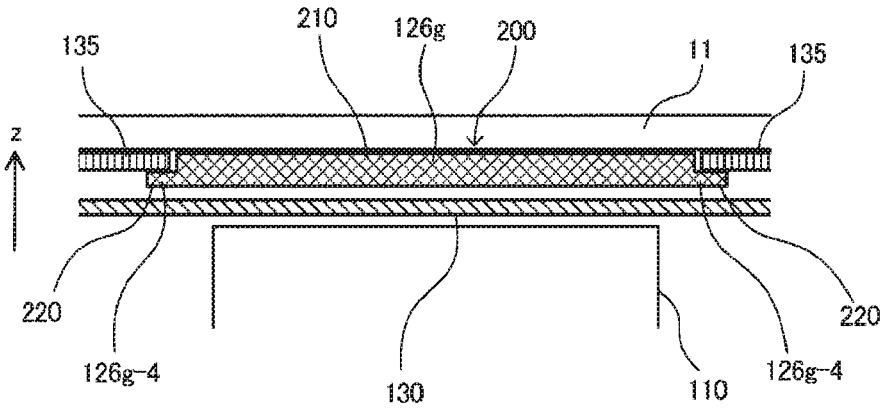
FIG. 12 is a partial section view of the electronic timepiece according to the first embodiment of the invention through the antenna in the direction perpendicular to the radial direction.

FIG. 11 is a section view through line A-A in FIG. 10 (a section view of the electronic timepiece 10 according to the first embodiment of the invention in the radial direction through the antenna 110). FIG. 12 is a section view through line B-B in FIG. 10 (a section view of the electronic timepiece 10 according to the first embodiment of the invention perpendicularly to the radial direction through the antenna 110).

As described above, the electronic timepiece 10 has a cover 200, and the cover 200 is a member with a main cover part 210. The main cover part 210 has an overlap with the antenna 110 in plan view, and in section view is a part disposed with an overlap between the area where the main cover part 210 is disposed in the thickness direction, and the area where the solar battery 135 is disposed in the thickness direction. The main cover part 210 and solar battery 135 have parts disposed at the same height. The antenna 110 is disposed with a part that does not overlap the solar battery 135 (or at least the solar cells 135*c*) in plan view.

Using a cover 200 has the following effect. Disposing the main cover part 210 overlapping the part where the solar battery 135 is not disposed above the antenna 110 in plan view can obscure the part where the solar battery 135 is not present. Furthermore, by having an overlap in section view between the area where the first part is disposed in the thickness direction, and the area where the solar battery 135 is disposed in the thickness direction, the member that obscures the part where the solar battery 135 is not present need not be disposed superimposed with the solar battery 135 in the thickness direction, and increasing the thickness of the electronic timepiece 10 can be suppressed. The difference in the position of the main cover part 210 in the thickness direction, and the position of the solar battery 135 in the thickness direction, can also be suppressed and introduction of a step therebetween can be inhibited. As a result, this part can be more effectively obscured.

The dial bridge ring 126 has a cantilevered part 126*g* that extends in plan view to the area inside the outside case 30. The cantilevered part 126*g* is disposed to have an overlap with the antenna 110 in plan view, and an overlap in section view between the area where the cantilevered part 126*g* is disposed in the thickness direction, and the area where the solar battery 135 is disposed in the thickness direction. By thus disposing the cantilevered part 126*g*, the cantilevered part 126*g* can also function as a main cover part 210. By having a cantilevered part 126*g* (by the cantilevered part 126*g* including at least part of the main cover part 210), the dial bridge ring 126 used as a member supporting the dial 11 can be used as a cover 200 obscuring the part where the solar battery 135 is not present above the antenna 110. Furthermore, because the dial bridge ring 126 can also be used as the cover 200, an increase in the parts count resulting from providing a cover 200 can also be suppressed.

As described above, the cover 200 can be configured to include the dial bridge ring 126. Note that while the cover 200 is configured to include the dial bridge ring 126 and date indicator bridge 131 in the third embodiment described below, the cover 200 is configured to include the dial bridge ring 126 but without including the date indicator bridge 131 in this first embodiment.

As will be understood from FIG. 10 and FIG. 11, the date indicator 130 and date indicator bridge 131 are disposed overlapping the antenna 110 in plan view. The date indicator bridge 131 is disposed on the inside circumference side of the date indicator 130. The thickness of the date indicator bridge 131 is greater than the thickness of the date indicator 130, and the edge on the outside circumference side of the date indicator bridge 131 extends like an eave over the inside circumference edge of the date indicator 130, limiting the range of vertical play in the date indicator 130. The date indicator bridge 131 thus holds the date indicator 130.

The cantilevered part 126*g* of the dial bridge ring 126 is disposed between the antenna 110 and dial 11. The cantilevered part 126*g* (main cover part 210) includes parts with different thicknesses, that is, the antenna cover 126*g*-1, date indicator cover 126*g*-2, and date indicator bridge cover 126*g*-3.

Of the antenna cover 126*g*-1, date indicator cover 126*g*-2, and date indicator bridge cover 126*g*-3, the antenna cover 126*g*-1 is the part disposed farthest to the outside circumference side. The antenna cover 126*g*-1 is disposed to fill the gap between the antenna 110 and the dial 11 where the date indicator 130 and date indicator bridge 131 are not present between the antenna 110 and dial 11; and is the thickest of the antenna cover 126*g*-1, date indicator cover 126*g*-2, and date indicator bridge cover 126*g*-3 parts.

Of the antenna cover 126*g*-1, date indicator cover 126*g*-2, and date indicator bridge cover 126*g*-3, the date indicator cover 126*g*-2 is the part disposed second closest to the outside circumference side. The date indicator cover 126*g*-2 is disposed to fill the gap between the date indicator 130 and dial 11 where the date indicator 130 is present but the date indicator bridge 131 is not present between the antenna 110 and dial 11; and is the second thickest of the antenna cover 126*g*-1, date indicator cover 126*g*-2, and date indicator bridge cover 126*g*-3 parts.

Of the antenna cover 126*g*-1, date indicator cover 126*g*-2, and date indicator bridge cover 126*g*-3, the date indicator bridge cover 126*g*-3 is the part located farthest to the inside (farthest from the outside circumference side). The date indicator bridge cover 126*g*-3 is disposed to fill the space between the date indicator bridge 131 and dial 11 where the date indicator 130 and date indicator bridge 131, or the date indicator bridge 131, are not present between the antenna 110 and dial 11; and is the thinnest of the antenna cover 126*g*-1, date indicator cover 126*g*-2, and date indicator bridge cover 126*g*-3 parts.

The cantilevered part 126*g* (main cover part 210) can thus be configured with parts of differing thickness. By disposing the cantilevered part 126*g* (main cover part 210) with the parts of different thickness corresponding to the other members (the date indicator 130 and date indicator bridge 131 in this example) disposed in the space between the antenna 110 and dial 11, gaps between parts can be easily filled.

As will be understood from FIG. 10 and FIG. 12, the cantilevered part 126*g* (cover 200) has an eave extension 126*g*-4, which is a part overlapping the solar battery 135 in plan view. The eave extension 126*g*-4 is disposed to a pair of edges extending in the direction the cantilevered part 126*g* extends, on the bottom part of the cantilevered part 126*g*, and extending below the edge of the notch 135*g* in the solar battery 135. In plan view, the eave extension 126*g*-4 overlaps the solar battery 135, and can suppress formation of a conspicuous gap between the cantilevered part 126*g* (cover 200) and the solar battery 135. Of the cover 200, the part superimposed in plan view with the solar battery 135 is referred to below as the overlap 220 (second part).

In this example, the overlap 220 is not disposed on the edge extending perpendicularly to the direction in which the cantilevered part 126*g* extends, but the date indicator bridge 131 is located below this edge. As a result, the gap between the cantilevered part 126*g* and solar battery 135 is difficult to see even though the overlap 220 is not disposed at this edge. Note that the overlap 220 may be disposed at this edge as necessary. In this case, a channel (clearance member) in which the overlap 220 can be fit may be formed in the date indicator bridge 131.

The foregoing first embodiment describes using the dial bridge ring 126 as a cover 200. The cover 200 is not so limited, however, and may be configured in other ways such as described below.

Embodiment 2

A second embodiment of the invention is described next with reference to FIG. 13. This second embodiment uses the date indicator bridge 131 as a cover 200.

Figure 13:
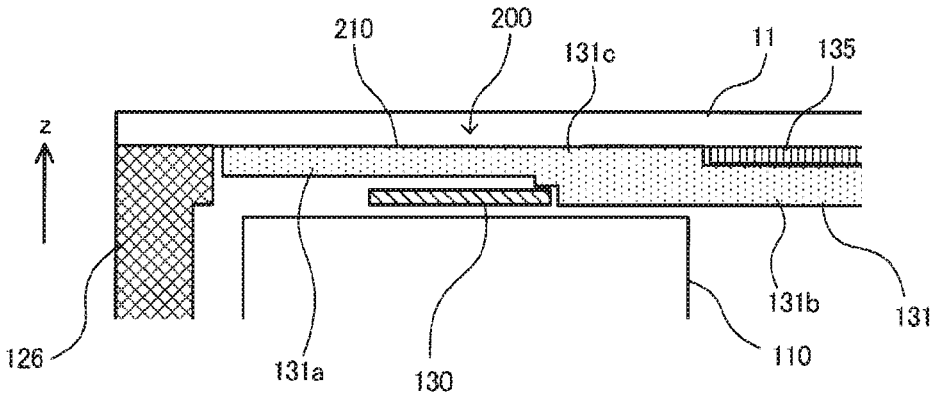
FIG. 13 is a partial section view of the electronic timepiece according to a second embodiment of the invention in the radial direction through the antenna.

FIG. 13 is a partial section view of the electronic timepiece 10 according to the second embodiment of the invention in the radial direction through the antenna 110 (a section view corresponding to FIG. 11 of the first embodiment).

In the second embodiment, the dial bridge ring 126 does not have a cantilevered part 126*g*. The date indicator bridge 131 has a cantilevered part 131*a* (second cantilevered part) extending in plan view toward the outside case 30. The cantilevered part 131*a* extends to the outside circumference side from the date indicator 130 (to the side near the outside case 30).

The cantilevered part 131*a* of the date indicator bridge 131 has an overlap with the antenna 110 in plan view, and is disposed in section view so that the area where the cantilevered part 131*a* is disposed in the thickness direction, and the area where the solar battery 135 is disposed in the thickness direction, have an overlap. By thus disposing the cantilevered part 131*a*, the cantilevered part 131*a* also functions as a main cover part 210. By having a cantilevered part 131*a* (by the cantilevered part 131*a* including at least part of the main cover part 210), the date indicator bridge 131 used as a member supporting the date indicator 130 can be used as a cover 200 obscuring the part where the solar battery 135 is not present above the antenna 110.

The date indicator bridge 131 may also be configured with the following features. That is, the date indicator bridge 131 has an under-solar battery part 131*b* (third part), which is disposed superimposed with the solar battery 135 in plan view (that is, disposed below the solar battery 135); and an antenna cover 131*c* (fourth part), which is disposed not superimposed with the solar battery 135 in plan view (is disposed on the outside circumference side of the under-solar battery part 131*b*), and is superimposed with the antenna 110. The antenna cover 131*c* extends from the under-solar battery part 131*b* toward (above) the solar battery 135 in the thickness direction.

The antenna cover 131*c* has an overlap with the antenna 110 in plan view, and is disposed in section view so that the area where the antenna cover 131*c* is disposed in the thickness direction, and the area where the solar battery 135 is disposed in the thickness direction, have an overlap. By thus disposing the antenna cover 131*c*, the antenna cover 131*c* also functions as a main cover part 210. By having an antenna cover 131*c* (by the antenna cover 131*c* including at least part of the main cover part 210), the date indicator bridge 131 used as a member supporting the date indicator 130 can be used as a cover 200 obscuring the part where the solar battery 135 is not present above the antenna 110.

In the second embodiment of the invention, the date indicator bridge 131 supporting the date indicator 130 is also used as the cover 200. As a result, an increase in the parts count resulting from providing a cover 200 can also be suppressed.

As described above, the cover 200 can be configured to include the date indicator bridge 131. Note that while the cover 200 is configured to include the dial bridge ring 126 and date indicator bridge 131 in the third embodiment described below, the cover 200 in this second embodiment is configured to include the date indicator bridge 131 but not include the dial bridge ring 126.

Embodiment 3

A third embodiment of the invention is described next with reference to FIG. 14. This third embodiment describes a configuration using the dial bridge ring 126 and the date indicator bridge 131 as a cover 200 (a configuration in which the cover 200 includes the dial bridge ring 126 and date indicator bridge 131).

Figure 14:
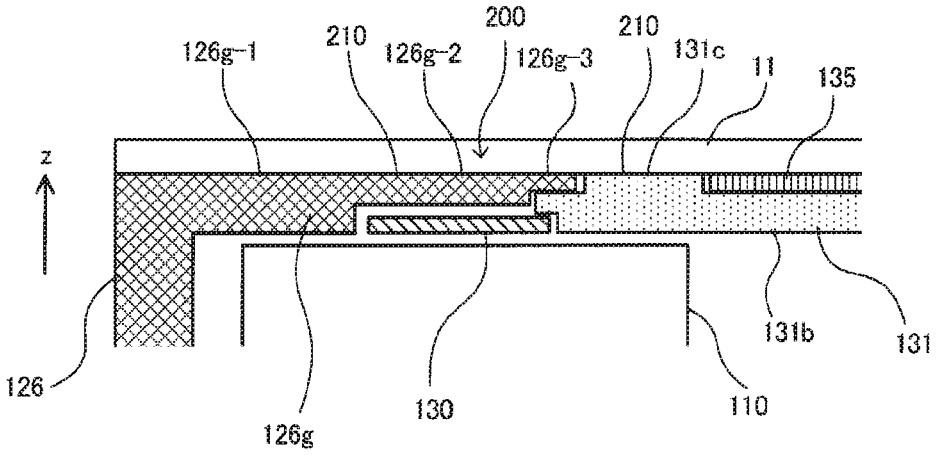
FIG. 14 is a partial section view of the electronic timepiece according to a third embodiment of the invention in the radial direction through the antenna.

FIG. 14 is a partial section view of the electronic timepiece 10 according to the third embodiment of the invention in the radial direction through the antenna 110 (a section view corresponding to FIG. 11 of the first embodiment).

In this example, the end on the inside circumference side of the date indicator bridge cover 126*g*-3 part of the cantilevered part 126*g* of the dial bridge ring 126 in the first embodiment is shortened. The resulting space is then filled by the date indicator bridge 131.

More specifically, the thickness of the antenna cover 131*c* of the date indicator bridge 131 on the outside circumference side of the solar battery 135 is increased toward the dial 11 so that the antenna cover 131*c* fills this space. As a result, the part of the main cover part 210 in this space is configured by the antenna cover 131*c* of the date indicator bridge 131. On the outside circumference side of this space, the main cover part 210 is embodied by the cantilevered part 126*g* of the dial bridge ring 126 as in the first embodiment.

The main cover part 210 may thus be configured to include the dial bridge ring 126 in one part, and include the date indicator bridge 131 in another part. Configuring the main cover part 210 from multiple members increases the freedom of design in the construction of the individual members that function as the main cover part 210. For example, the cantilevered part 126*g* of the dial bridge ring 126 can be shortened compared with the first embodiment. As a result, warping (bending) of the cantilevered part 126*g* can be suppressed.

Note that the end of the cantilevered part 126*g* on the inside circumference side is disposed to rest on the outside circumference edge of the date indicator bridge 131. As a result, formation of a gap between the dial bridge ring 126 and date indicator bridge 131 in plan view can be suppressed.

Embodiment 4

A fourth embodiment of the invention is described next with reference to FIG. 15 and FIG. 16. This fourth embodiment uses members other than the dial bridge ring 126 and date indicator bridge 131 as a cover 200.

Figure 15:
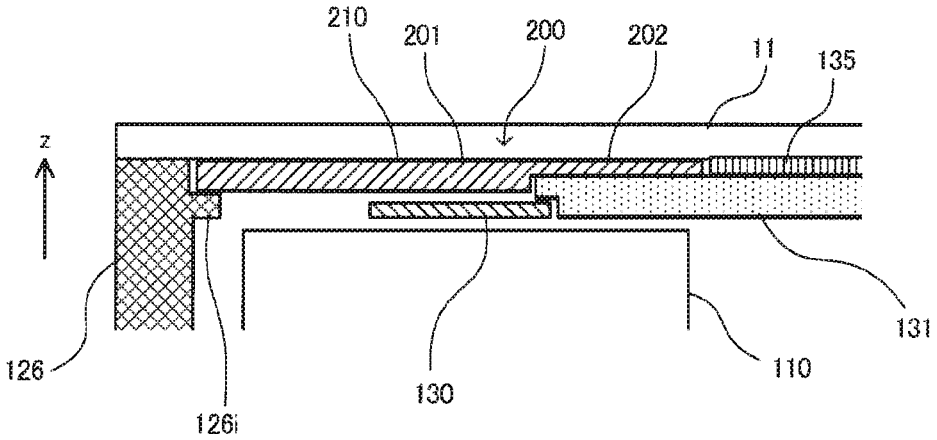
FIG. 15 is a partial section view of the electronic timepiece according to a fourth embodiment of the invention in the radial direction through the antenna.
Figure 16:
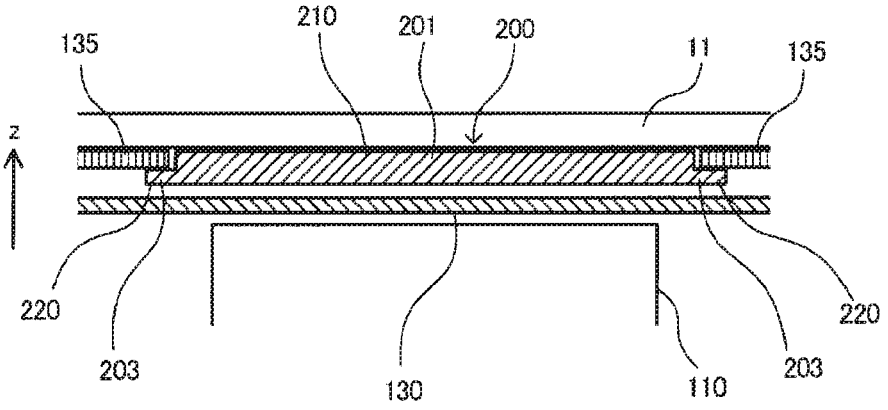
FIG. 16 is a partial section view of the electronic timepiece according to a fourth embodiment of the invention through the antenna in the direction perpendicular to the radial direction.

FIG. 15 is a partial section view of the electronic timepiece 10 according to the fourth embodiment of the invention in the radial direction through the antenna 110 (a section view corresponding to FIG. 11 of the first embodiment). FIG. 16 is a partial section view of the electronic timepiece 10 according to the fourth embodiment of the invention in the direction perpendicular to the radial direction through the antenna 110 (a section view corresponding to FIG. 12 of the first embodiment).

In the fourth embodiment, the dial bridge ring 126 and date indicator bridge 131 do not include the main cover part 210 (a part having an overlap with the antenna 110 in plan view, and in section view disposed with an overlap between the area where the main cover part 210 is disposed in the thickness direction, and the area where the solar battery 135 is disposed in the thickness direction). The cover 200 with a main cover part 210 is disposed as a member separate from the dial bridge ring 126 and date indicator bridge 131.

A cover 200 can therefore be provided in the electronic timepiece 10 without changing the structure of the dial bridge ring 126 and date indicator bridge 131.

As will be understood from FIG. 15, the cover 200 according to the fourth embodiment of the invention has an outside circumference part 201 disposed on the outside circumference side of the date indicator bridge 131, and an inside circumference part 202 on the inside circumference side of the outside circumference part 201.

The inside circumference part 202 is disposed resting on the date indicator bridge 131, and the thickness of the inside circumference part 202 is substantially the same as the thickness of the solar battery 135.

The thickness of the outside circumference part 201 extends below the solar battery 135 and is greater than the thickness of the outside circumference part 201.

As will be understood from FIG. 16, an eave extension 203 forming an overlap 220 is disposed at the edge part of the outside circumference part 201 and extending below the edge of the solar battery 135. The cover 200 is a single plastic piece molded to the shape described above.

A flange 126*i* projecting to the inside circumference side is disposed to the inside circumference surface of the dial bridge ring 126, and the edge on the outside circumference side of the outside circumference part 201 of the cover 200 rests on the flange 126*i*. As a result, formation of a gap between the dial bridge ring 126 and cover 200 in plan view is suppressed.

Variation 1 of Embodiment 4

Figure 17:
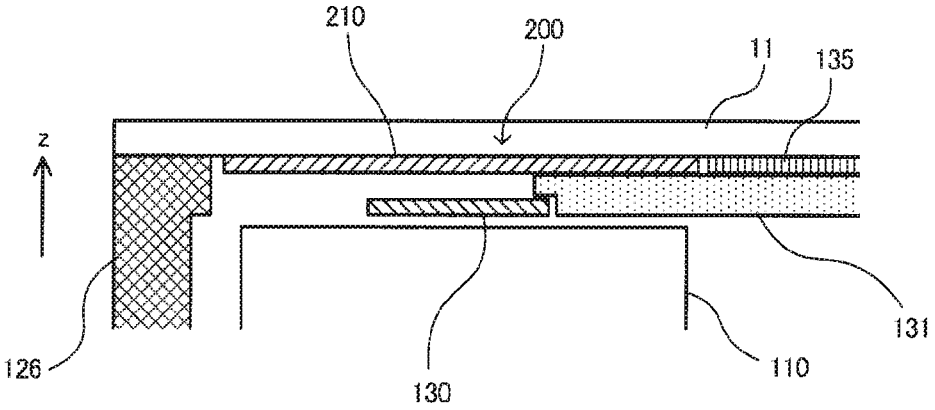
FIG. 17 is a partial section view of the electronic timepiece according to a first variation of the fourth embodiment of the invention in the radial direction through the antenna.
Figure 18:
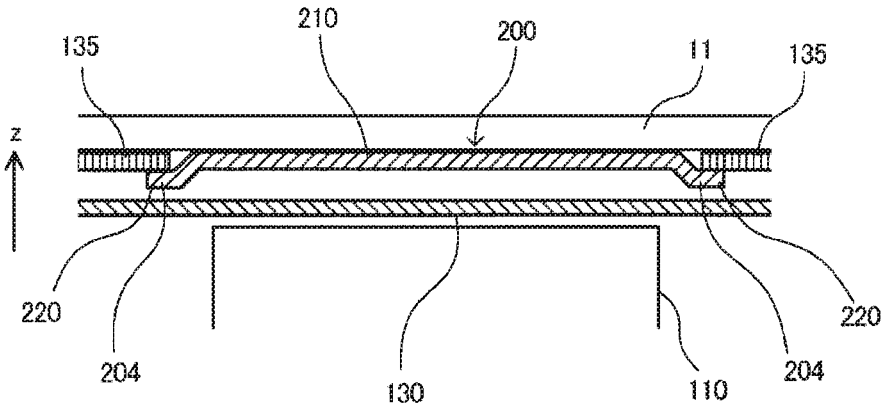
FIG. 18 is a partial section view of the electronic timepiece according to a first variation of the fourth embodiment of the invention through the antenna in the direction perpendicular to the radial direction.

A first variation of the fourth embodiment (referred to below as the first variation) is described below with reference to FIG. 17 and FIG. 18. FIG. 17 is a partial section view of the electronic timepiece 10 according to this first variation in the radial direction through the antenna 110 (a section view corresponding to FIG. 11 of the first embodiment). FIG. 18 is a partial section view of the electronic timepiece 10 according to this first variation in the direction perpendicular to the radial direction through the antenna 110 (a section view corresponding to FIG. 12 of the first embodiment).

While the cover 200 is a plastic member in the example described in the fourth embodiment, the cover 200 in this first variation is made from a plastic film.

As will be understood from FIG. 17, the cover 200 according to this first variation is a film of a uniform thickness. The cover 200 is disposed resting on the date indicator bridge 131 on the inside circumference side, and the thickness of the cover 200 is substantially the same as the thickness of the solar battery 135 (less than or equal to the thickness of the solar battery 135).

As will be understood from FIG. 18, the overlap 220 is formed by deforming (bending) the edge 204 of the cover 200 in the thickness direction so that the edge 204 fits below the edge of the solar battery 135.

In this first variation, even if the thickness of the cover 200 is substantially equal to the thickness of the solar battery 135, the overlap 220 can be formed by easily deforming (bending) the cover 200 using the flexibility of the plastic film.

Variation 2 of Embodiment 4

Figure 19:
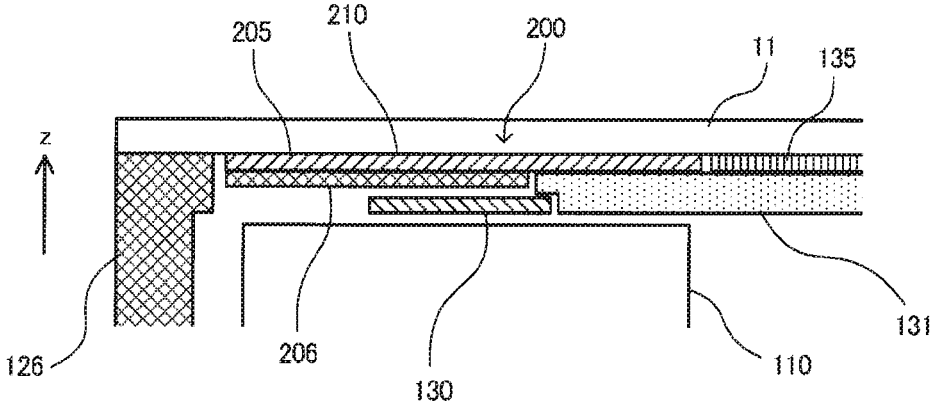
FIG. 19 is a partial section view of the electronic timepiece according to a second variation of the fourth embodiment of the invention in the radial direction through the antenna.
Figure 20:
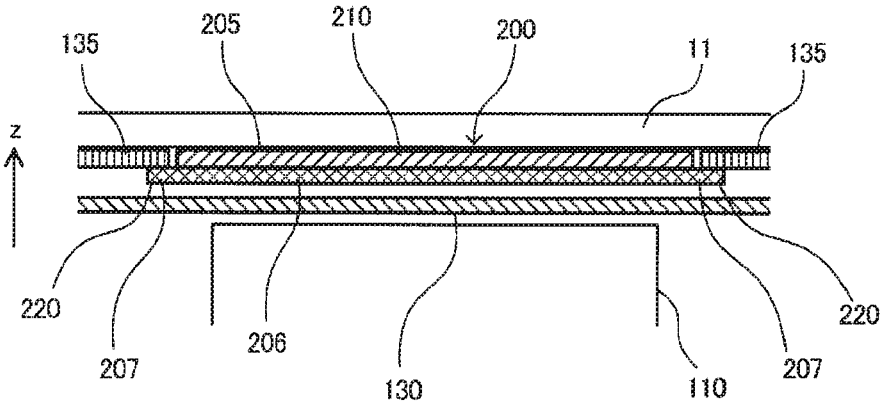
FIG. 20 is a partial section view of the electronic timepiece according to a second variation of the fourth embodiment of the invention through the antenna in the direction perpendicular to the radial direction.

A second variation of the fourth embodiment (referred to below as the second variation) is described below with reference to FIG. 19 and FIG. 20. FIG. 19 is a partial section view of the electronic timepiece 10 according to this second variation in the radial direction through the antenna 110 (a section view corresponding to FIG. 11 of the first embodiment). FIG. 20 is a partial section view of the electronic timepiece 10 according to this second variation in the direction perpendicular to the radial direction through the antenna 110 (a section view corresponding to FIG. 12 of the first embodiment).

While the cover 200 is a plastic member of one layer in the example described in the first variation, the cover 200 in this second variation is made from a plastic film of two layers.

As will be understood from FIG. 19, the cover 200 according to this second variation comprises a first film 205 (first member) disposed resting on the date indicator bridge 131 on the inside circumference side, and a second film 206 (second member) disposed on the outside circumference side of the date indicator bridge 131 on the bottom side of the first film 205.

As will be understood from FIG. 20, the edge 207 of the second film 206 is disposed extending below the edge of the solar battery 135, forming an overlap 220.

In plan view, the first film 205 has an overlap with the antenna 110, is disposed so that the area where the first film 205 is disposed in the thickness direction, and the area where the solar battery 135 is disposed in the thickness direction, overlap in section view; and functions as the main cover part 210 of the cover 200 (includes the main cover part 210). The second film 206 has an overlap with the solar battery 135 in plan view, and functions as the overlap 220 of the cover 200 (includes the overlap 220).

By forming the first film 205 and second film 206 to overlap and form the cover 200, this second variation can form the overlap 220 without deforming (bending) the film as in the first variation. Furthermore, the cover 200 including the main cover part 210 and overlap 220 is easily formed using the simple construction of stacking the first film 205 and second film 206 together. The first film 205 and second film 206 may be formed from flat plastic members.

Note that in the fourth embodiment and the first and second variations thereof, the cover 200 may be configured integrally with the solar battery 135 by bonding the cover 200 to the solar battery 135 with the overlap 220 therebetween. Assembling the electronic timepiece 10 is also simplified by integrating the cover 200 with the solar battery 135.

The invention is described above with reference to preferred embodiments and variations thereof, but the invention is not so limited. For example, various changes, improvements, and combinations thereof will be obvious to one familiar with the related art.

For example, the main cover part 210 of the cover 200 may be disposed in plan view to cover only part, and not all of, the antenna 110. Compared with a configuration not having a cover 200, this configuration can effectively obscure the area where the solar battery 135 is not disposed above the antenna 110.

Furthermore, at least part of the main cover part 210 may be embodied by the main plate 125. In other words, bridges or support members other than the dial bridge ring 126 and date indicator bridge 131 may be used as support members forming at least part of the main cover part 210. For example, the main plate 125 supporting the wheel trains may be used.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-055078, filed Mar. 21, 2017 is expressly incorporated by reference herein.

What is claimed is:

1. An electronic timepiece comprising:

an optically transmissive dial having one surface to which external light is incident, and another surface from which the external light is emitted;

a solar battery disposed relative to the dial in the direction in which the external light is emitted, having a photovoltaic solar cell, and defining a notch therein;

an antenna disposed relative to the dial in the direction in which the external light is emitted and configured to receive radio signals; and a cover member overlapping the notch in the solar battery and having a first part disposed between the dial and the antenna, the antenna having a part that does not overlap the solar cell in plan view from the thickness direction which is perpendicular to the face of the dial, the part that does not overlap the solar cell overlapping the notch, and the first part of the cover member overlapping with the antenna in plan view, and the first part of the cover member overlapping the solar battery in the thickness direction when viewed in a direction perpendicular to the thickness direction.

2. The electronic timepiece described in claim 1, wherein:

the cover member has a second part that overlaps the solar battery in plan view.

3. The electronic timepiece described in claim 1, wherein:
the cover member includes a first support member configured to hold the dial; and
the first support member includes at least part of the first part.

4. The electronic timepiece described in claim 3, wherein:
the first support member has a first cantilevered part housed inside an outside case, and extending in plan view to the inside of the outside case;
the first cantilevered part including at least part of the first part.

5. The electronic timepiece described in claim 1, wherein:
the cover member includes a second support member configured to support a date indicator;
the second support member including at least part of the first part.

6. The electronic timepiece described in claim 5, wherein:
the second support member has a second cantilevered part housed inside an outside case, and extending in plan view to the outside case;
the second cantilevered part including at least part of the first part.

7. The electronic timepiece described in claim 5, wherein:
the second support member has a third part overlapping the solar battery in plan view, and a fourth part not overlapping the solar battery and overlapping the antenna in plan view;
the fourth part extending, relative to the third part, in the thickness direction in the direction of the solar battery, and including at least part of the first part.

8. The electronic timepiece described in claim 1, wherein:
the first part has multiple parts of different thickness.

9. The electronic timepiece described in claim 1, further comprising:
a first support member that supports the dial; and
a second support member that supports a date indicator;
the cover member being embodied by members other than the first support member and second support member.

10. The electronic timepiece described in claim 9, wherein:
the cover member is a plastic film and has a second part that overlaps the solar battery in plan view; and
the second part is formed by deforming the film in the thickness direction.

11. The electronic timepiece described in claim 10, wherein:
the cover member is bonded to the solar battery through the second part.

12. The electronic timepiece described in claim 9, wherein:
the cover member includes a second part that overlaps the solar battery in plan view,
the first member including the first part, and the second member including the second part, overlapping.

13. An electronic timepiece comprising:
an optically transmissive dial having one surface to which external light is incident, and another surface from which the external light is emitted;
a solar battery disposed relative to the dial in the direction in which the external light is emitted, having a photovoltaic solar cell, and defining a notch therein;
an antenna disposed relative to the dial in the direction in which the external light is emitted and configured to receive radio signals; and
a cover member overlapping the notch in the solar battery and having a first part disposed between the dial and the antenna,
in plan view, the antenna having a part not overlapping the solar cell, the part that does not overlap the solar cell overlapping the notch, and the first part of the cover member having a part overlapping the part of the antenna not overlapping the solar cell; and
the first part of the cover member overlapping the solar battery in a section view.

* * * * *